US005460107A

United States Patent [19]

Hulit et al.

[11] Patent Number: 5,460,107

[45] Date of Patent: Oct. 24, 1995

[54] ROLLER ACTIVATED STOP MOTION MECHANISM FOR AN EYELET BUTTONHOLE MACHINE

[75] Inventors: Ronald A. Hulit, Mechanicsville; Joseph M. Hamill, King William; Anthony M. Lewandowski, II, Mechanicsville, all of Va.

[73] Assignee: AMF Reece, Inc., Mechanicsville, Va.

[21] Appl. No.: 128,559

[22] Filed: Sep. 29, 1993

[51] Int. Cl.[6] ..... D05B 3/08

[52] U.S. Cl. ..... 112/67; 112/271

[58] Field of Search ..... 112/65, 66, 67, 112/220, 264.1, 274, 271, 276, 277; 188/29, 31, 74

[56] References Cited

U.S. PATENT DOCUMENTS

| | | | |
|---|---|---|---|
| 2,825,296 | 3/1958 | Sweet et al. | 112/67 X |
| 3,499,404 | 3/1970 | Nicolay | 112/67 |
| 3,804,038 | 4/1974 | Martin et al. | 112/67 |
| 3,894,500 | 7/1975 | Hsiao | 112/67 X |
| 3,908,569 | 9/1975 | Fujii | 112/67 |
| 4,455,956 | 6/1984 | Yamamoto et al. | 112/67 X |
| 4,730,565 | 3/1988 | Iizuka | 112/67 |

*Primary Examiner*—Clifford D. Crowder
*Assistant Examiner*—Ishmael Izaguirre
*Attorney, Agent, or Firm*—James Creighton Wray

[57] ABSTRACT

The present invention relates to the braking mechanism of sewing machines and provides a smooth stop motion to halt the machine. The braking phase of the stop motion involves a roller controlled brake pad which slows down the machine prior to the stop dog contacting the stop bolt. The roller, when activated, runs along the right hand stop wheel and verifies the distance of the brake pad from the stop wheel for one revolution. The roller falls into an indentation and is then ejected away from the right hand stop wheel by a notch, thereby descending the brake pad a small distance onto the stop wheel for one more revolution. At this point, the brake attenuates much of the machine's momentum. After one revolution of braking, the machine comes to a smooth stop.

10 Claims, 4 Drawing Sheets

FIG. 1
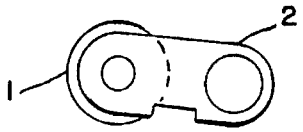
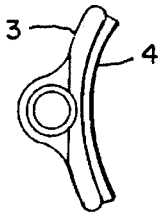
FIG. 2
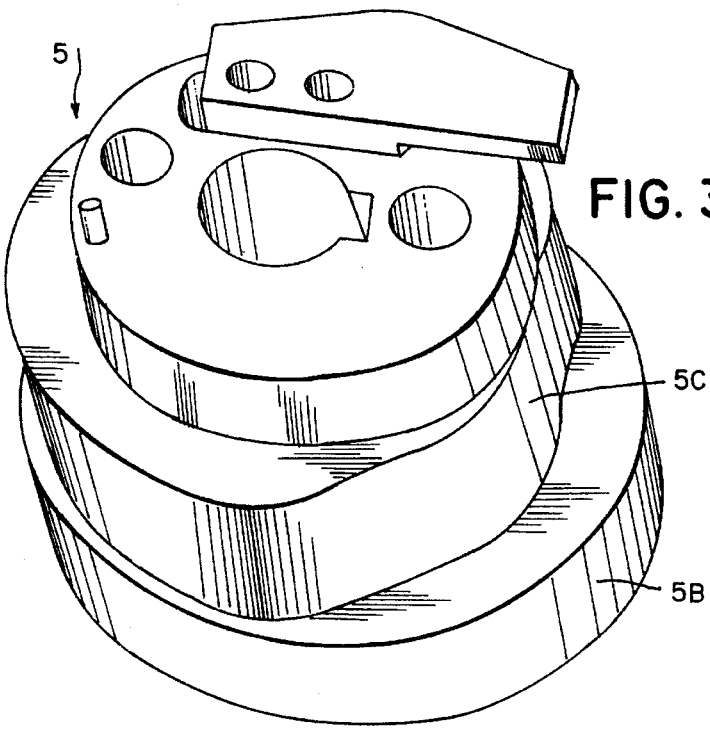
FIG. 3
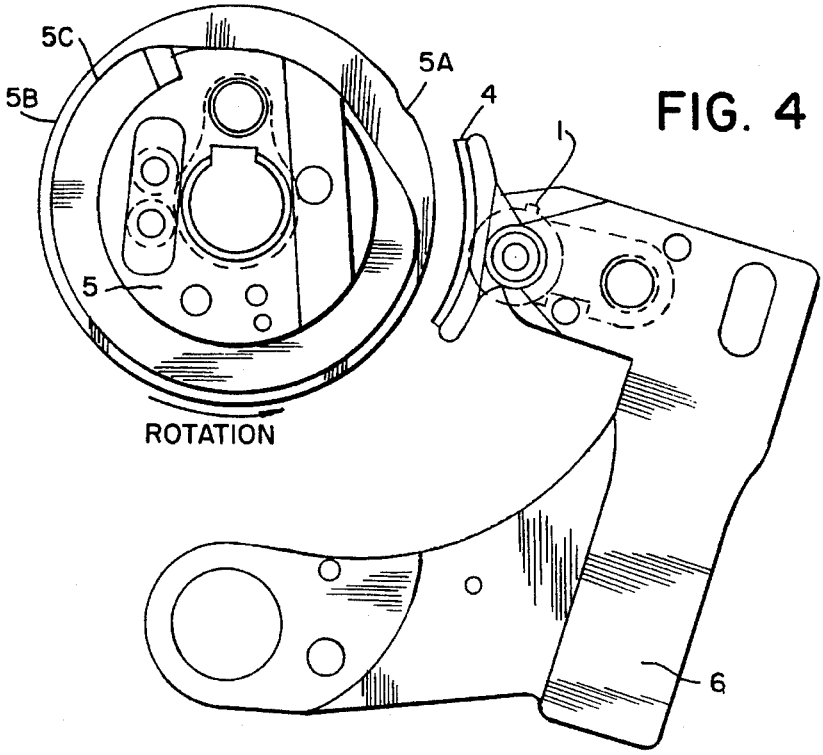
FIG. 4

| DET | PART NUMBER | DESCRIPTION |
|---|---|---|
| .01 | 10-1087-0-000 | BRACKET |
| .02 | 14-1085-0-000 | FLYOVER LEVER |
| .03 | 01-5007-0-000 | SPRING |
| .04 | 01-4002-0-000 | WASHER |
| .05 | 10-1086-0-000 | SCREW |
| .06 | 01-3005-0-000 | NUT |
| 07 | 01-2017-0-000 | SCREW |
| 08 | 01-6638-0-000 | PIN ROLL |
| 09 | 14-1084-0-000 | WEAR PAD |

| DET | DESCRIPTION |
|---|---|
| 10 | DOG |
| 11 | LOCK WASHER |
| 12 | NUT |
| 13 | SCREW |
| 14 | ECCENTRIC |

ROLLER ACTIVATED STOP MOTION MECHANISM FOR AN EYELET BUTTONHOLE MACHINE

BACKGROUND OF THE INVENTION

FIELD OF THE INVENTION

This invention applies to an eyelet buttonhole machine that is stopped in one revolution of the main stitching shaft by using methods such as a stop dog contacting a stop bolt. The stopping action is very violent. This stop motion presents an innovative method of slowing the machine down. By using roller control to reliably situate the brake pad above the cam before engaging contact of the brake with the cam, most of the reliability problems associated with the stop motion have been eliminated.

In the area of the braking, the first phase of stopping an eyelet buttonhole machine, there have been many and various methods used. One method is to use a fly over lever to hold back the brake pad until activating the contact with the cam surface. Using this technique, if the brake begins too far from the surface, it could skip along the cam, resulting in poor attenuation of the speed and the possibility of missing the recess with the stopper arm. Among others, dual pulley systems and spring systems were also attempted but never performed satisfactorily. Most had the similar problems as the fly over lever system or just could not absorb enough of the energy to slow the machine down. All other systems also required constant adjustments to maintain the stopping mechanism.

SUMMARY OF THE INVENTION

The object of the invention is to provide a device that consistently stops the machine without faults such as double stops.

Another purpose of the invention is to decrease the number of adjustments that must be made to the assembly. By eliminating adjustments and parts, the machine stays in calibration for longer periods of time and thus is more efficient.

Another purpose of the invention is to correctly positions the brake pad so as to get one full revolution of braking.

This stop motion mechanism reduces noise, eliminates four areas of adjustment including the eccentric for the latch and vertical, horizontal and lateral movement of the fly over lever. Fourteen parts (1 thru 14 in FIGS. 7 and 8) are eliminated resulting in less wear and maintenance. More efficient brake contact will result in longer stop bolt life and less damage to the machine overall.

When the brake is initially actuated, the brake pad and roller control release. The roller contacts the outer cam surface of the stop wheel, verifying the distance of the brake pad from the cam. The roller then allows the brake pad to contact the cam at exactly a predetermined position and slow the machine down for one revolution before the sudden stop.

BRIEF DESCRIPTION OF THE DRAWINGS

FIG. 1 is the roller and roller latch.

FIG. 2 is the brake shoe and brake pad.

FIG. 3 is the stop wheel.

FIG. 4 illustrates the roller and brake in the sewing position.

DETAILED DESCRIPTION OF THE DRAWING AND DESCRIPTION OF THE PREFERRED EMBODIMENT

Figure 5:
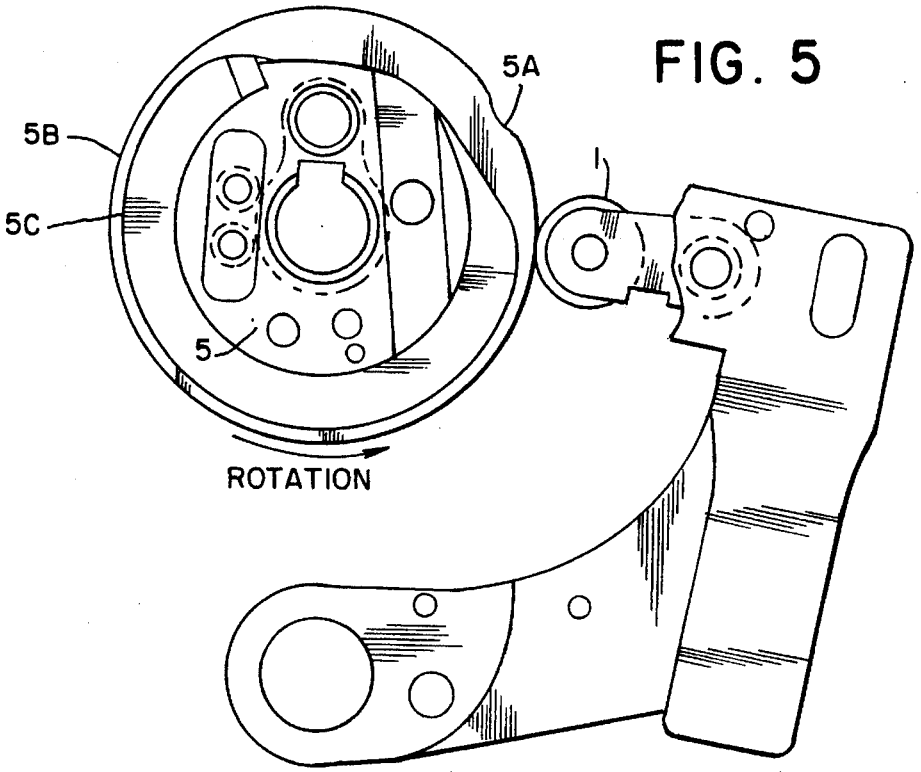
FIG. 5 illustrates the mechanism approaching last stitch with the roller contacting the cam of the stop wheel.
Figure 6:
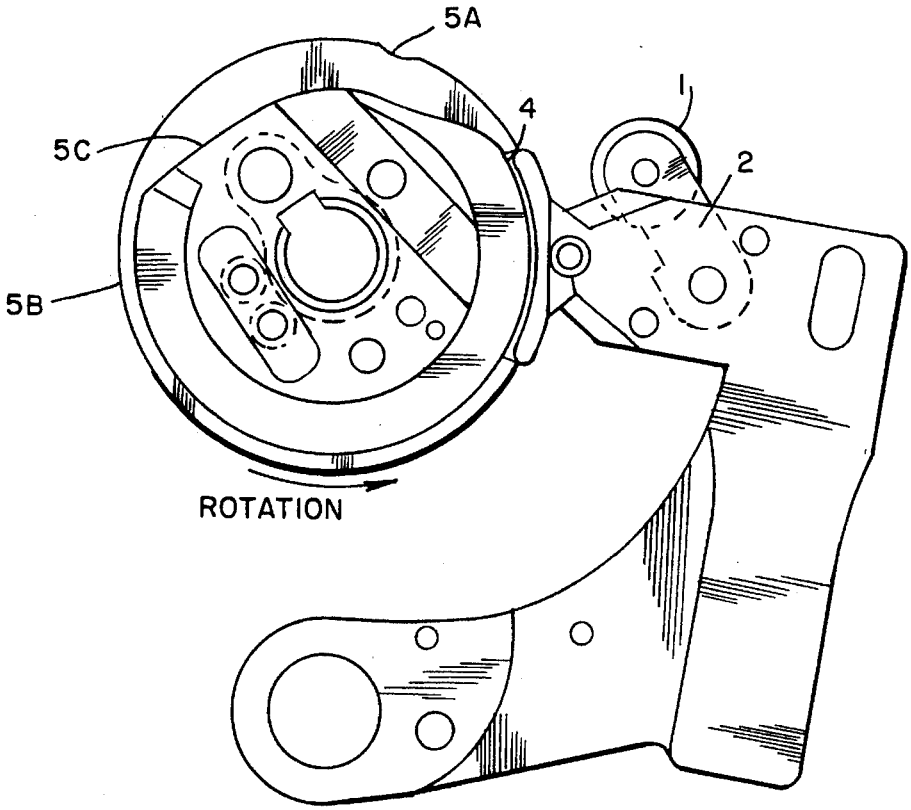
FIG. 6 illustrates the mechanism in last stitch position with the brake pad contacting the cam of the stop wheel.
Figure 7:
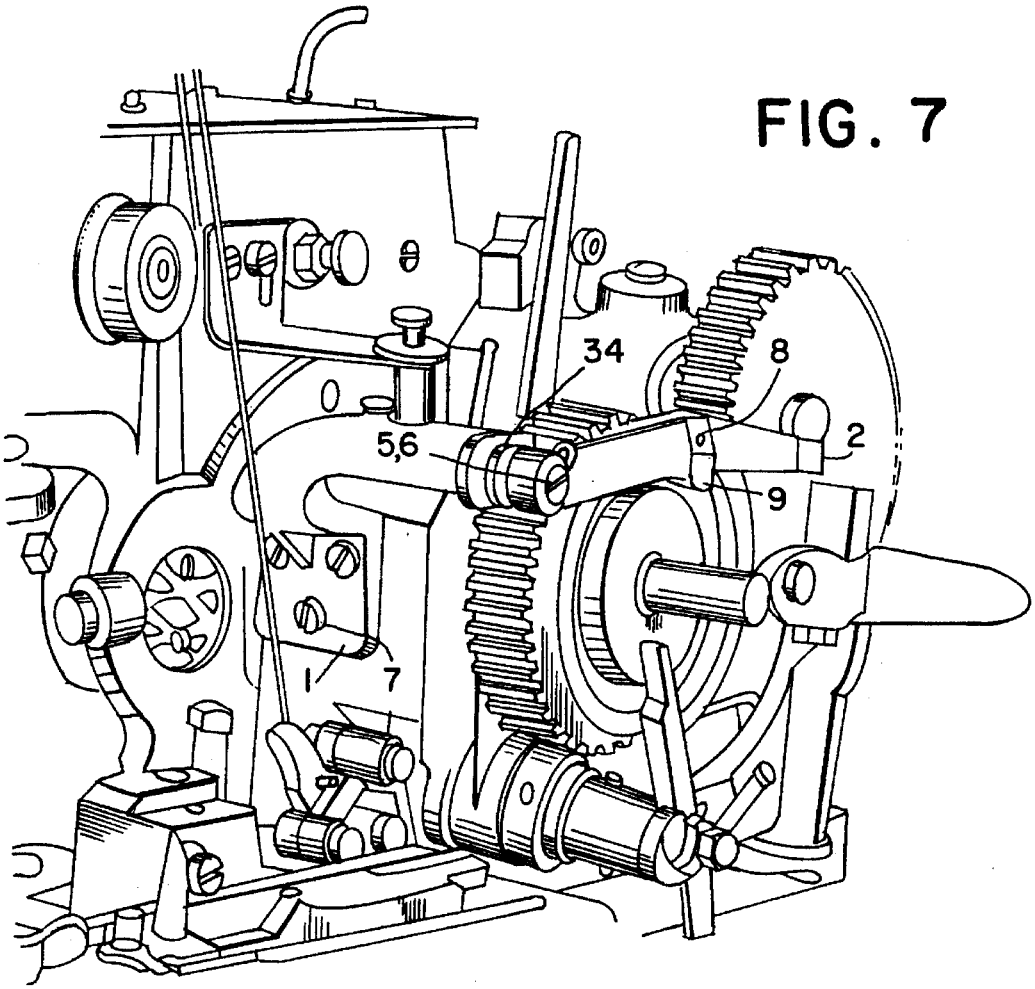
FIG. 7 pictures parts from the old version of the stop motion which have been eliminated.
Figure 8:
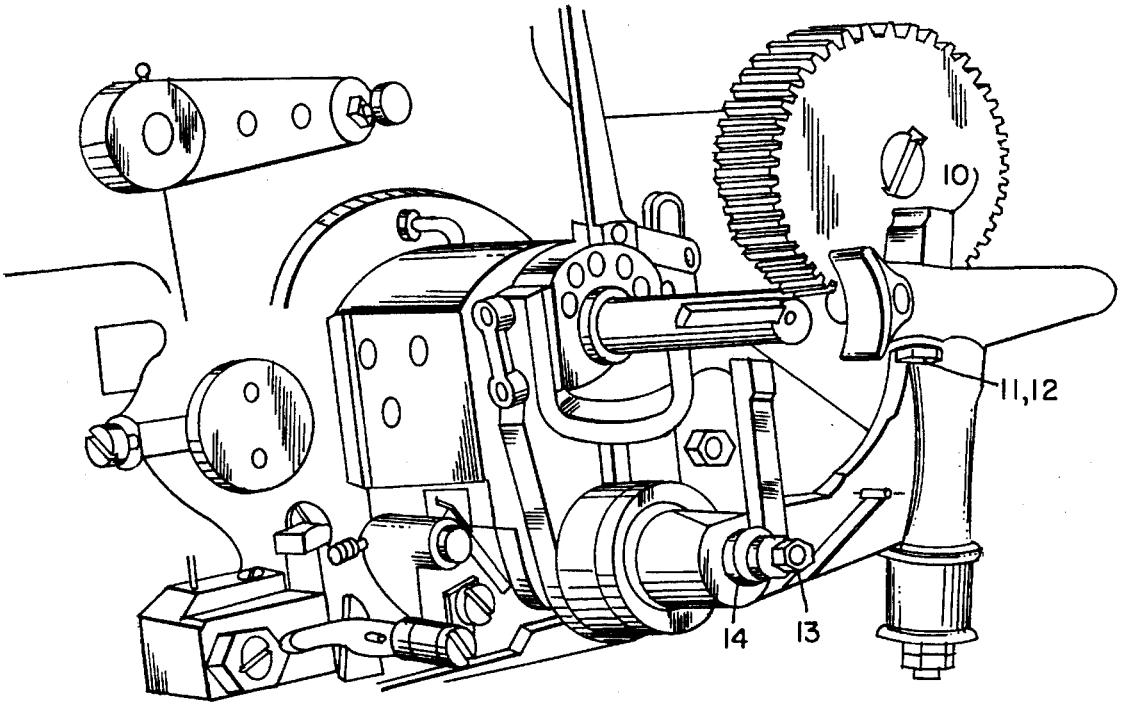
FIG. 8 pictures parts from the old version of the stop motion which have been eliminated.

The rocking lever 6 is initially set back in position by a roller along the length gage. This position can be seen in FIG. 4. The machine then runs through its sewing cycle. As the machine reaches it's last stitch, the rear end of the length gage makes contact with the screw on the trip lever (not shown) and allows the rocking lever 6 to come forward and the roller 1 makes contact with the cam surface 5B of the right hand stop wheel 5 as seen in FIG. 5. The roller 1 and roller latch 2 and the distance between cam surface 5B and 5C verify the distance of the brake pad 4 from the cam surface 5C. The distance of the brake pad 4 while the roller 1 is contacting the right hand stop wheel 5 is between 30 and 50 thousands of an inch (0.762 to 1.270 mm). The roller 1 follows the wheel surface 5B until it falls into an indentation 5A in the cam surface, allowing the brake pad 4 to make contact with the stop wheel surface 5C. The roller 1 is kicked out at the end of the indentation. At this point as shown in FIG. 6, the machine is on the last stitch. The brake 4 contacts the cam surface 5C for exactly one revolution, making contact at the exact same position on the stop wheel every time. At the end of the last stitch, the stop dog makes contact with the stop bolt in the rocking lever.

The distance that the roller 1 holds the brake pad 4 from the stop wheel surface 5C is non-adjustable. The 30 to 50 thousandths of an inch (0.762 to 1.270 mm) is built into the tolerances of the roller latch 2 and roller 1 itself. There are also no adjustments for when the brake pad 4 is contacted to the cam surface 5C. The contact is always made as the roller I falls into the indentation 5A in the stop.

We claim:

1. A roller controlled braking system for providing a stop motion in a sewing machine, comprising:

a) a right hand stop wheel with a cam having two cam surfaces, one to guide a roller and one to contact a brake;

b) a roller latch attached to the roller for allowing the roller to contact the stop wheel and determine a distance between the stop wheel and the brake and to subsequently release the brake for contacting the brake with the stop wheel on a last stitch; and c) a brake pad in the brake contacting the stop wheel at a predesignated point on the cam when the roller latch releases the brake.

2. A braking apparatus for sewing machines comprising:

a stop wheel with first and second cam surfaces;

a roller provided near a distal end of a rocking lever proximal the stop wheel for contacting the first cam surface;

a roller latch attached to the roller for pivotally moving the roller to a first position contacting the first cam surface and a second position moving away from the first cam surface respectively;

a brake pad connected to the distal end of the rocking lever for frictionally contacting the second cam surface.

3. The apparatus of claim 2, wherein the roller latch further comprises means for determining a distance of the brake pad from the cam surface and for subsequently releasing the brake pad to contact the stop wheel on a last stitch.

4. The apparatus of claim 2, further comprising an indentation in the stop wheel for receiving and ejecting the roller away from the first cam surface.

5. The apparatus of claim 2, further comprising the cam surfaces having a predesignated point for causing the roller latch to release the roller and for receiving the brake pad on the cam surfaces.

6. The apparatus of claim 2, wherein the first cam surface is for guiding the roller when the brake is activated, and wherein the second cam surface is for contacting the brake pad when the roller latch releases the roller.

7. A braking method for providing stop motion for sewing machines comprising the steps of:

actuating a braking system;

transferring the stop motion to a stop wheel having first and second cam surfaces;

contacting a roller provided near a distal end of a rocking lever proximal the stop wheel with the first cam surface of the stop wheel;

releasing a roller latch attached to the roller for contacting the first cam surface of the stop wheel;

ejecting the roller away from the cam surface;

rotatably moving the roller to a second position away from the first cam surface;

contacting a brake pad connected to the distal end of the rocking lever with the second cam surface for effecting the stop motion.

8. The method of claim 7, wherein the releasing comprises measuring a distance of the brake pad from the cam surface and releasing the brake pad to contact the stop wheel on a last stitch.

9. The method of claim 7, wherein the ejecting the roller away from the first cam surface is by means of an indentation on the stop wheel.

10. The method of claim 7, further comprising providing a predesignated point on the cam for causing the roller latch to release the roller to move away from the first cam surface and for receiving the brake pad on the second cam surface.

* * * * *